US006938582B2

(12) United States Patent
Shin

(10) Patent No.: US 6,938,582 B2
(45) Date of Patent: Sep. 6, 2005

(54) HEAT EXCHANGING TYPE BOILER

(76) Inventor: Chang Gun Shin, Samsung Apt. 2-405, 175 Oryu-dong, Chung-gu, 301-758 Taejeon (KR)

( * ) Notice: Subject to any disclaimer, the term of this patent is extended or adjusted under 35 U.S.C. 154(b) by 0 days.

(21) Appl. No.: 10/639,901

(22) Filed: Aug. 13, 2003

(65) Prior Publication Data

US 2004/0187795 A1 Sep. 30, 2004

Related U.S. Application Data

(63) Continuation of application No. PCT/KR02/00182, filed on Feb. 6, 2002.

(30) Foreign Application Priority Data

Feb. 13, 2001 (KR) ..... 2001-6964

(51) Int. Cl.[7] ..... F22B 1/02
(52) U.S. Cl. ..... 122/31.2; 122/18.1
(58) Field of Search ..... 122/15.1, 18.1, 122/20 B, 32, 31.2

(56) References Cited

U.S. PATENT DOCUMENTS 4,441,460 A 4/1984 Wyatt
4,768,495 A * 9/1988 Zifferer ..... 126/101
5,005,528 A * 4/1991 Virr ..... 122/4 D
5,271,378 A * 12/1993 Herold ..... 126/360.2
5,735,235 A * 4/1998 Li ..... 122/1 R

FOREIGN PATENT DOCUMENTS

EP 0316132 5/1989
JP 2000088203 3/2000

* cited by examiner

*Primary Examiner*—Gregory Wilson
(74) *Attorney, Agent, or Firm*—St. Onge Steward Johnston & Reens LLC

(57) ABSTRACT

The present invention relates to a heat exchanging type boiler that includes: a water retaining reservoir 10 in which a predetermined amount of water is charged; and a combustion chamber 33 for emitting heating gas at a high temperature to the water in the water retaining reservoir 10 through a heating gas supply pipe 20 such that the water in the water retaining reservoir 10 is raised to produce steam at a high pressure, the boiler characterized in that a water discharging film 32 disposed between the heating gas supply pipe 20 and the water and having a plurality of fine through holes such that the water in the water retaining reservoir 10 is not leaked to the combustion chamber 33 and at the same time the heating gas emitted to the water by means of the heating gas supply pipe 20 is distributed in substantially small bubble form. Thus, water heating speed can be considerably increased, heat efficiency of the boiler can be more improved, a volume of the boiler can be decreased, the life of the boiler can be semi-permanently extended since the water retaining reservoir is not directly heated, and the cleaning of the interior of the boiler can be carried out in an easy manner.

12 Claims, 7 Drawing Sheets

HEAT EXCHANGING TYPE BOILER

CROSS-REFERENCES TO RELATED APPLICATIONS

This application is a continuation of pending International Patent Application No. PCT/KR02/00182 filed Feb. 6, 2002, which designates the United States and claims priority of pending Korean Application No. 2001-6964, filed Feb. 13, 2001. Both PCT Application No. PCT/KR/02/00182 and Korean Application No. 2001/6964 are incorporated herein by reference.

BACKGROUND

1. Field of the Invention

The present invention relates to a heat exchanging type boiler, and more particularly, to a heat exchanging type boiler that produces heating gas of a bubble shape come into contact with water in a water reservoir, thus to make it possible to heat the water therein.

2. Description of the Related Art

Generally, a boiler is a device which heats water in a closed tank from the inside or outside in order to provide hot water or steam at high temperature and high pressure. The water or steam at the high temperature is used for the heating in a building, while it at the high pressure is used for the activation of a steam turbine in a heat power station to thereby produce electric power.

Various studies for the boiler are made to reduce an amount of waste heat energy except an amount of heat energy consumed for heating water. Recently, there is provided a supercharged boiler that is adapted to supply compressed air in a combustion chamber in order to improve a combustion efficiency in the combustion chamber.

Typically, the conventionally developed boiler is provided with a water retaining reservoir which is made of a metal material having a high heat conductivity and in which a predetermined amount of water is contained. In order to produce steam, thus, the water retaining reservoir is heated from the inside or outside, or a water pipe through which the water passes communicates to the combustion chamber such that the water pipe is heated.

In other words, the heating gas (which is generated by burning solid, liquid or gas) at the high temperature as a heat source in the conventionally used boiler comes in contact with the water retaining reservoir or the water pipe having the high heat conductivity such that heat energy is primarily transferred from the heating gas to the water retaining reservoir or the water pipe and the water retaining reservoir or the water pipe to which the heat energy is transferred comes in contact with water, thereby secondarily transferring the heat energy to the water. In this case, the conventional boiler heats the water in an indirect way of making the heat energy of the heat gas necessarily pass through the water retaining reservoir or the water pipe as a heat transfer medium on a path where the heat energy is transferred to the water.

In the conventionally used boiler, however, the heat energy, which passes through the water retaining reservoir or the water pipe, is much consumed for raising the temperature of the reservoir or the water pipe such that the heat energy is easily emitted to the outside of the boiler due to the high heat conductivity of the water retaining reservoir or the water pipe, which makes the heat efficiency of the boiler substantially low. In addition, the convection current of water in the water retaining reservoir or the water pipe is only used in order to raise the total temperature of the water, such that heating speed is very low and it is difficult to increase the heat efficiency over a predetermined level.

In order to expand the heat transfer area of the reservoir or the pipe, also, the reservoir or the pipe is designed to be bent many times, which results in a high manufacturing cost. Due to the complicated structure, moreover, a relatively long period of time is consumed to clean the reservoir or the pipe.

The water retaining reservoir or the water pipe has the high heat conductivity, but has a relatively low chemical resistance, such that it can be easily to be exposed to corrosion. And, the impurities in the water are combined to produce scale that is attached onto the inner wall of the water retaining reservoir, which makes the heat transfer efficiency substantially low. Thereby, the heat expansion on the wall surface of the water retaining reservoir occurs unevenly such that the boiler is broken. This results in the decrement of the life cycle of the boiler and frequent cleaning of the interior of the boiler.

SUMMARY OF THE INVENTION

It is an object of the present invention to provide a heat exchanging type boiler that produces heat energy in heating gas that is directly transferred to water, without passing through a heat transfer medium, distributes the bubbles of the heating gas to thereby enable heat transfer area to be maximized, and causes the even mixture of the water with a rising force produced while the bubbles of the heating gas rise in the water, whereby water heating speed can be considerably increased and heat efficiency of the boiler can be more improved.

It is another object of the present invention to provide a heat exchanging type boiler that is provided with a water retaining reservoir having a relatively simple structure, since heat transfer does not occur in the water retaining reservoir, whereby the volume of the boiler can be decreased and the material cost of the boiler can be reduced.

It is another object of the present invention to provide a heat exchanging type boiler that is provided with a water retaining reservoir that is made of insulation material and heat resisting material having a generally high chemical resistance, such that it can be easily not to be exposed to corrosion, forms turbulence in the water retaining reservoir by the bubbles of heating gas, such that the impurities in the water according to the combination of the organic and inorganic substances don't almost occur and an impurity layer such as even scale that is attached onto the inner wall of the water retaining reservoir prevents the heat transfer of the water retaining reservoir with a result of maintaining the hot water in the water retaining reservoir, whereby the heat efficiency of the boiler can be improved, the life of the boiler can be semi-permanently extended since the water retaining reservoir is not directly heated, and the cleaning of the interior of the boiler can be carried out in an easy manner.

In order to achieve these and other objects of the present invention, according to a first aspect of the present invention, there is provided a heat exchanging type boiler including a water retaining reservoir in which a predetermined amount of water is charged, and a combustion chamber for emitting heating gas at a high temperature to the water in the water retaining reservoir through a heating gas supply pipe such that the water in the water retaining reservoir is raised to produce steam at a high pressure, characterized in that a water discharging film disposed between the heating gas supply pipe and the water and having a plurality of fine through holes such that the water in the water retaining reservoir is not leaked to the combustion chamber and at the same time the heating gas emitted to the water by means of the heating gas supply pipe is distributed in substantially small bubble form.

According to a second aspect of the present invention, there is provided a heat exchanging type boiler including a water retaining reservoir in which a predetermined amount of water is charged, a combustion chamber for emitting heating gas at a high temperature to the water in the water retaining reservoir through a heating gas supply pipe such that the water in the water retaining reservoir is raised to produce steam at a high pressure, and a bubble distributing plate disposed between the heating gas supply pipe and the water and having a plurality of fine through holes such that the heating gas emitted to the water by means of the heating gas supply pipe is distributed in substantially small bubble form, characterized in that the heating gas is emitted to the water in the water retaining reservoir in order to make the pressure of the heating gas emitted from the combustion chamber higher than the pressure in the water in the water retaining reservoir, such that the bubble distributing plate prevents the water in the water retaining reservoir from being leaked downward.

According to a third aspect of the present invention, there is provided a heat exchanging type boiler including a water retaining reservoir in which a predetermined amount of water is charged, a combustion chamber for emitting heating gas at a high temperature to the water in the water retaining reservoir through a heating gas supply pipe such that the water in the water retaining reservoir is raised to produce steam at a high pressure, and a bubble distributing plate disposed between the heating gas supply pipe and the water and having a plurality of fine through holes such that the heating gas emitted to the water by means of the heating gas supply pipe is distributed in substantially small bubble form, characterized in that a sprayer disposed on the upper portion of the combustion chamber for spraying the water to the heating gas such that the heating gas produced from the combustion chamber is emitted to the water in the water retaining reservoir, with steam contained therein.

According to a fourth aspect of the present invention, there is provided a heat exchanging type boiler including a water retaining reservoir in which a predetermined amount of water is charged, a combustion chamber for emitting heating gas at a high temperature to the water in the water retaining reservoir through a heating gas supply pipe such that the water in the water retaining reservoir is raised to produce steam at a high pressure, and a bubble distributing plate disposed between the heating gas supply pipe and the water and having a plurality of fine through holes such that the heating gas emitted to the water by means of the heating gas supply pipe is distributed in substantially small bubble form, characterized in that a burner disposed in the combustion chamber for producing the heating gas.

Preferably, the burner is provided with a flame hole through which a flame is emitted on the top surface and a water flow pipe disposed in the side adjacent to the flame hole for preventing the melting and oxidization of the flame hole.

Preferably, the flame hole is formed generally long in a length direction at the center of the top surface of the burner, and the water flow pipe is formed correspondingly to the length of the flame hole on the both sides of the flame hole, respectively.

According to a fifth aspect of the present invention, there is provided a heat exchanging type boiler including a water retaining reservoir in which a predetermined amount of water is charged, a combustion chamber for emitting heating gas at a high temperature to the water in the water retaining reservoir through a heating gas supply pipe such that the water in the water retaining reservoir is raised to produce steam at a high pressure, and a bubble distributing plate disposed between the heating gas supply pipe and the water and having a plurality of fine through holes such that the heating gas emitted to the water by means of the heating gas supply pipe is distributed in substantially small bubble form, characterized in that a filter film disposed on the lower portion is separated by a predetermined distance from the bottom surface of the bubble distributing plate, for filtering impurities contained in the heating gas.

Preferably, the filter film is provided with a predetermined amount of water and a space on the upper surface such that the heating gas which passes through the filter film contains the steam therein.

Preferably, the burner is provided with a flame hole through which a flame is emitted on the top surface and a partition disposed in the center of the interior in such a manner that the heating gas is supplied to the upper portion of the partition and cool water is supplied to the lower portion thereof, such that the heat conductivity of the cool water prevents the melting and oxidization of the flame hole.

BRIEF DESCRIPTION OF THE DRAWINGS

Further objects and advantages of the invention can be more fully understood from the following detailed description taken in conjunction with the accompanying drawings, in which.

DETAILED DESCRIPTION OF THE DRAWINGS

Now, an explanation of the preferred embodiments of the present invention will be described with reference to accompanying drawings.

Figure 1:
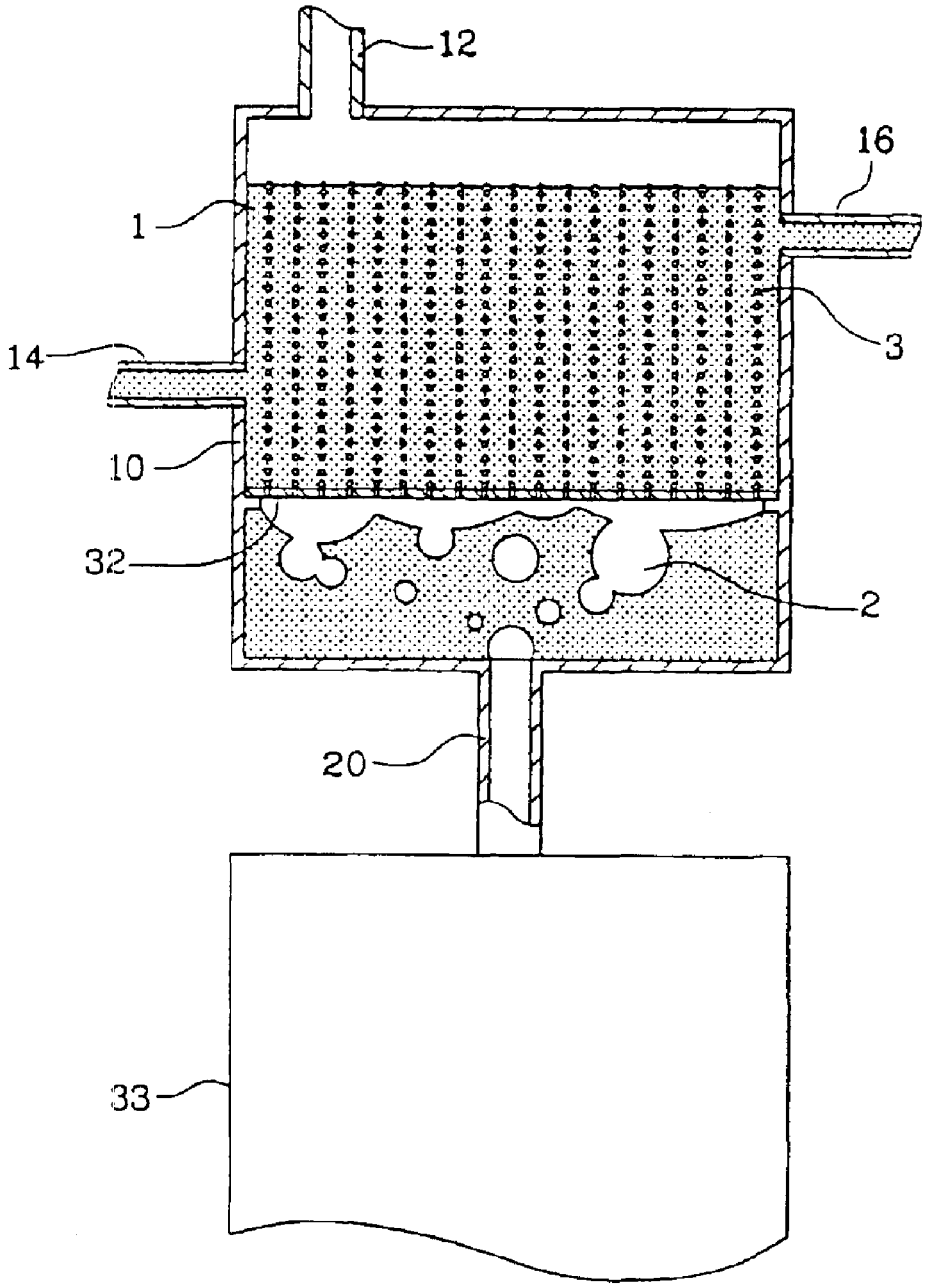
FIG. 1 is a schematic view illustrating a heat exchanging type boiler according to a first embodiment of the present invention.

Referring first to FIG. 1, a heat exchanging type boiler according to a first embodiment of the present invention includes a water retaining reservoir 10 in which a predetermined amount of water 1 is charged, and a heating gas supply pipe 20 for supplying bubbles of heating gas 2 at a high temperature in the water retaining reservoir 10, and a water discharging film 32 for distributing the bubbles of heating gas 2 emitted from the heating gas supply pipe 20 in extremely small bubble 3 form such that the contact area of the bubbles of heating gas 2 can be expanded.

In this case, the water retaining reservoir 10 is of a closed box shape, which is provided with a steam discharging pipe 12 through which the heating gas and steam are discharged on the ceiling side, a water supply pipe 14 for supplying the water 1 to the water retaining reservoir 10 on the one side, and a water discharging pipe 16 through which the water 1 is discharged on the other side.

Each of the steam discharging pipe 12, the water supply pipe 14 and the water discharging pipe 16 is provided with a valve (which is not shown in the drawing) that serves to adjust an amount of steam discharged or an amount of water charged.

At that time, the cool water 1 that flows to the interior of the water retaining reservoir 10 is forced to rise and get hot by means of the buoyancy of the extremely small bubbles, and as the hot water 1 is convected upward to the water retaining reservoir 10, the cool water 1 flows downward to the water retaining reservoir 10 through the water supply pipe 14 and is thus discharged upward through the water discharging pipe 16.

In this case, the water retaining reservoir 10 is made of a material having resistance to a relatively low temperature when compared with the conventional one, and it is preferably made of a plastic material that exhibits excellent heat resistance and insulation in order to keep the water 1 heated by the heating gas hot for a long period of time.

Therefore, the heat exchanging type boiler according to the present invention is capable of achieving instantaneous and fast heating of the water 1 with the extremely small bubbles 3 and circulation of the hot water 1 with a circulation pump (which is not shown) such that it can be used for heating a house in winter.

Also, the heat exchanging type boiler according to the present invention is embodied by the steam that is generated when water is heated over a boiling point by means of the heating gas at a high temperature. Thereby, the steam at the high temperature and pressure is discharged through the steam discharging pipe 12 disposed on the ceiling surface of the water retaining reservoir 10, together with the heating gas passing through the water and is thus used as heating, cooking or generating power. At this time, the water supply pipe 14 can be used only for solving the lack of water.

And, the water discharging film 32 is preferably adapted to prevent the water in the water retaining reservoir 10 from leaking downward and to supply the lower air to the water in the water retaining reservoir 10.

In addition to the water discharging film 32, in order to prevent the water in the water retaining reservoir 10 from leaking downward, there is provided a bubble distributing plate (which is not shown) through which the heating gas is distributed to bubbles, whereby the gas pressure higher than the water pressure in the water retaining reservoir 10 is discharged to the water retaining reservoir 10 such that the water in the water retaining reservoir 10 can be heated.

In this case, it is desirable that the gas pressure higher than the water pressure in the water retaining reservoir 10 is first discharged to the water retaining reservoir 10 with no water and the water is then supplied to the water retaining reservoir 10. Preferably, the temperature of the heating gas is adjusted in such a manner as not to affect the contents in the water retaining reservoir 10.

Figure 2:
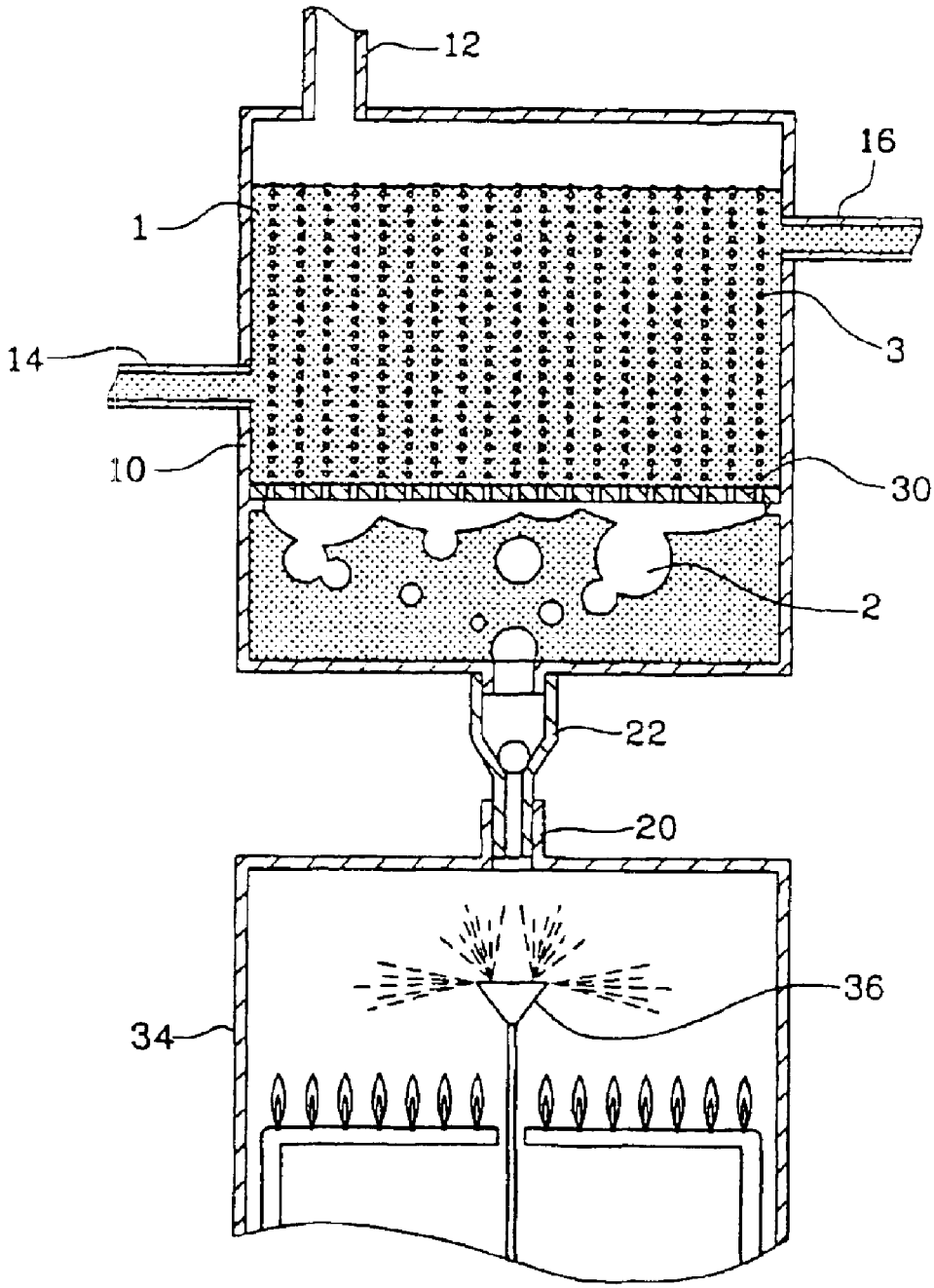
FIG. 2 is a schematic view illustrating a heat exchanging type boiler according to a second embodiment of the present invention.
Figure 3:
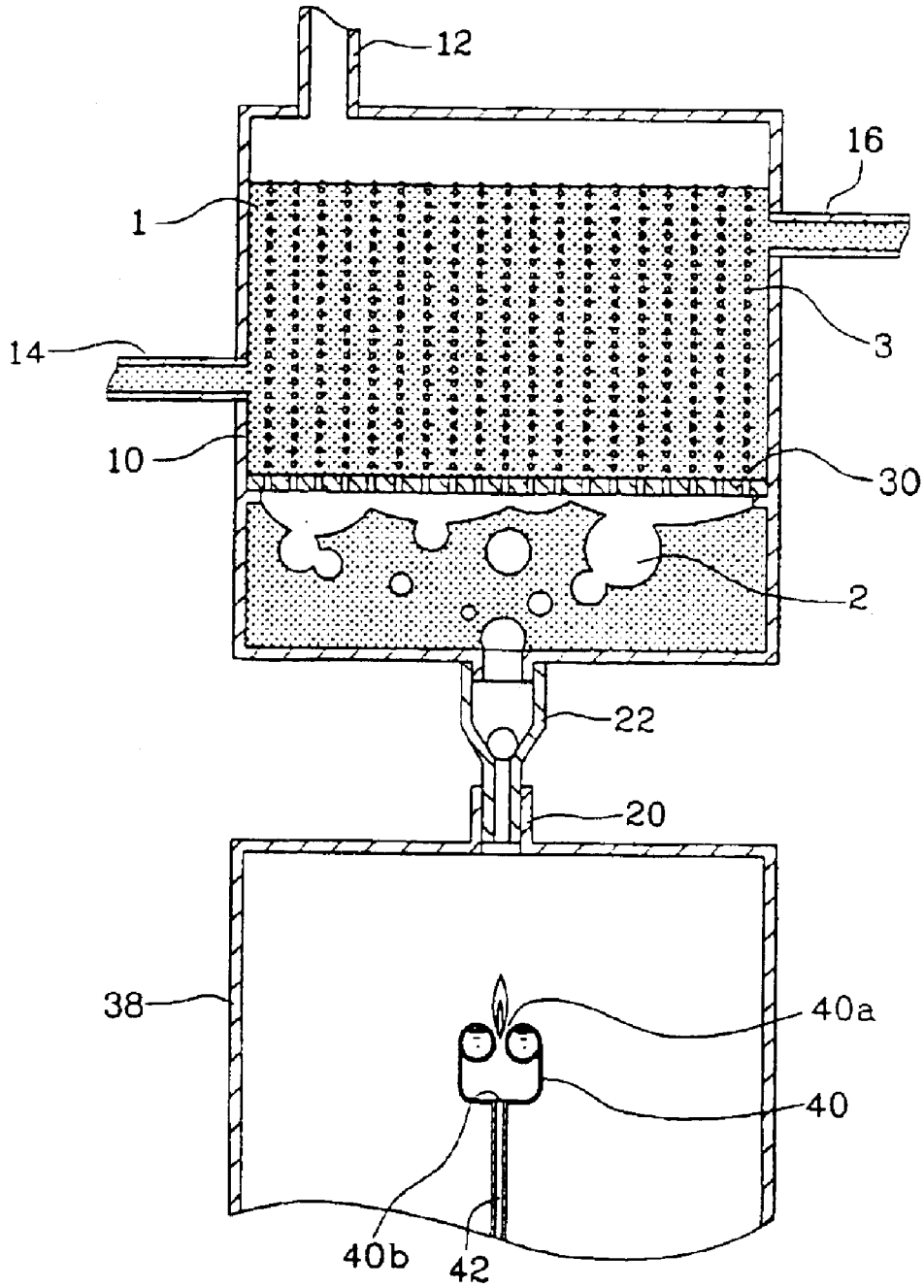
FIG. 3 is a schematic view illustrating a heat exchanging type boiler according to a third embodiment of the present invention.
Figure 7:
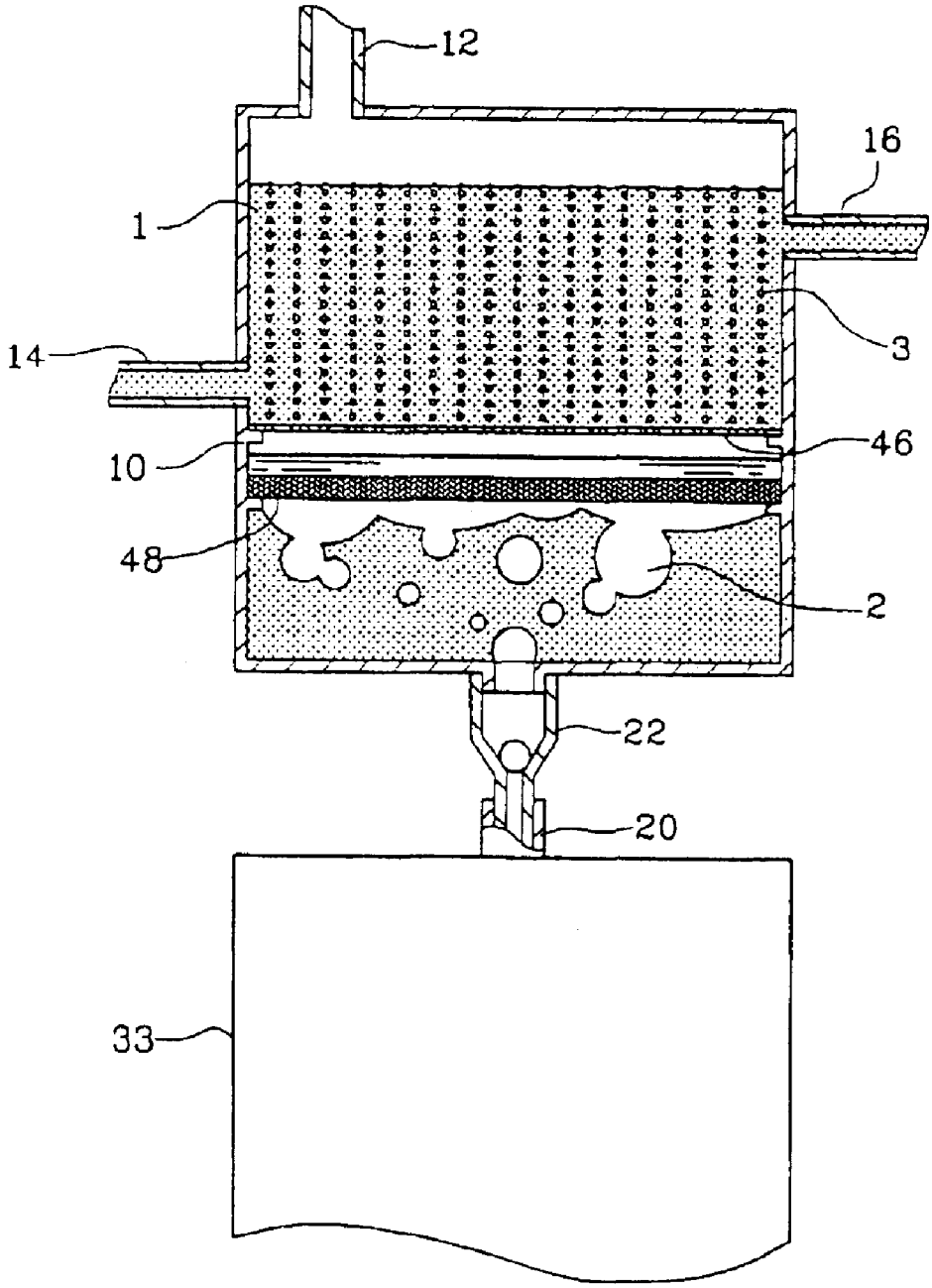
FIG. 7 is a schematic view illustrating a heat exchanging type boiler according to a fourth embodiment of the present invention.

On the other hand, referring to FIGS. 2, 3 and 7, the water distributing film 32 in FIG. 1 is replaced with a bubble distributing plate 30 or 46. And, the heating gas supply pipe 20 is provided with a counterflow preventing valve 22 that prevents the water in the water retaining reservoir 10 from leaking to the combustion chambers 33, 34 and 38.

Referring now to FIG. 2, an explanation of the heat exchanging type boiler according to a second embodiment of the present invention will be described.

In this embodiment of the present invention, a sprayer 36, which sprays fine water drops, is disposed on the upper portion spaced away from the flames in the combustion chamber 34. The sprayer 36 serves to spray the fine water drops to the heating gas at the high temperature generated from the combustion chamber 34 such that the heating gas contains steam and at the same time the temperature of the heating gas becomes low. As a quantity of water sprayed from the sprayer 36 is adjusted, the temperature of the heating gas can be controlled.

In case where the heating gas at a relatively low temperature that contains the steam is supplied to the water retaining reservoir 10, the properties of the organic materials (e.g., food or dyes) in the water retaining reservoir 10 can be kept without any change.

And, the sprayer 36 is desirably disposed spaced apart from the flames generated from the combustion chamber 34 such that the flames can be completely burnt.

Figure 4:
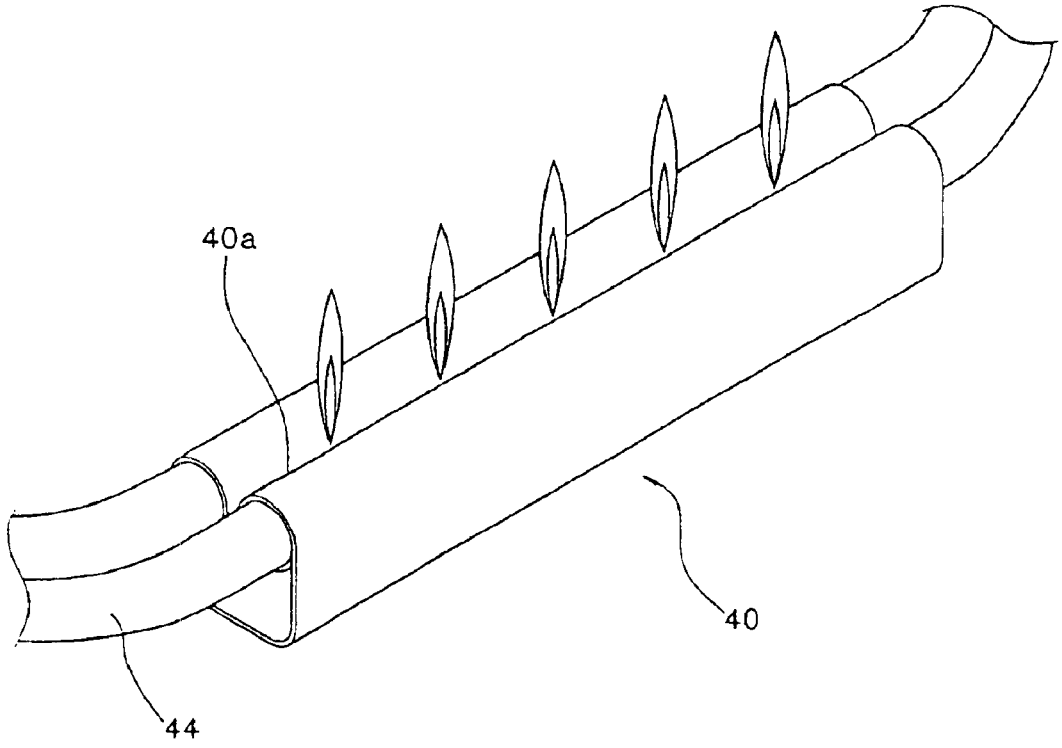
FIG. 4 is a perspective view of the burner in FIG. 3.

Referring now to FIGS. 3 and 4, an explanation of the heat exchanging type boiler according to a third embodiment of the present invention will be described.

The combustion chamber 38 is provided with a burner 40 for generating the heating gas. The burner 40 takes a generally square box shape and is provided with a flame hole 40*a* through which the flame is produced by an igniter (which is omitted) that is cut long vertically on the center of the upper surface along the length direction and with a gas inlet hole 40*b* that is connected to a gas hose 42 on the side or bottom surface.

The flame hole 40*a* of the burner 40 is provided with a water flow pipe 44 having a length corresponding to the flame hole 40*a* that is disposed in the both sides, respectively, for preventing the melting and oxidization of the flame hole 40*a*, using a water-cooling effect. As the water (cool water) continues to flow through the water flow pipe 44, the temperature of the flame hole 40*a* can be low. Thereby, the flame hole 40*a* has a high resistance to the flames, and therefore, the burner 40 can be made of a metal (e.g., aluminum) having a low melting point. With the metal at the low melting point, the flame hole 40*a* can be extremely small in size such that the length of the flame can be reduced. Thereby, the size (upper and lower widths) of the combustion chamber 38 can be reduced.

On the other hand, the burner 40 and the water flow pipe 44 are preferably formed in a unitary body in an extruding or casting manner.

Figure 5:
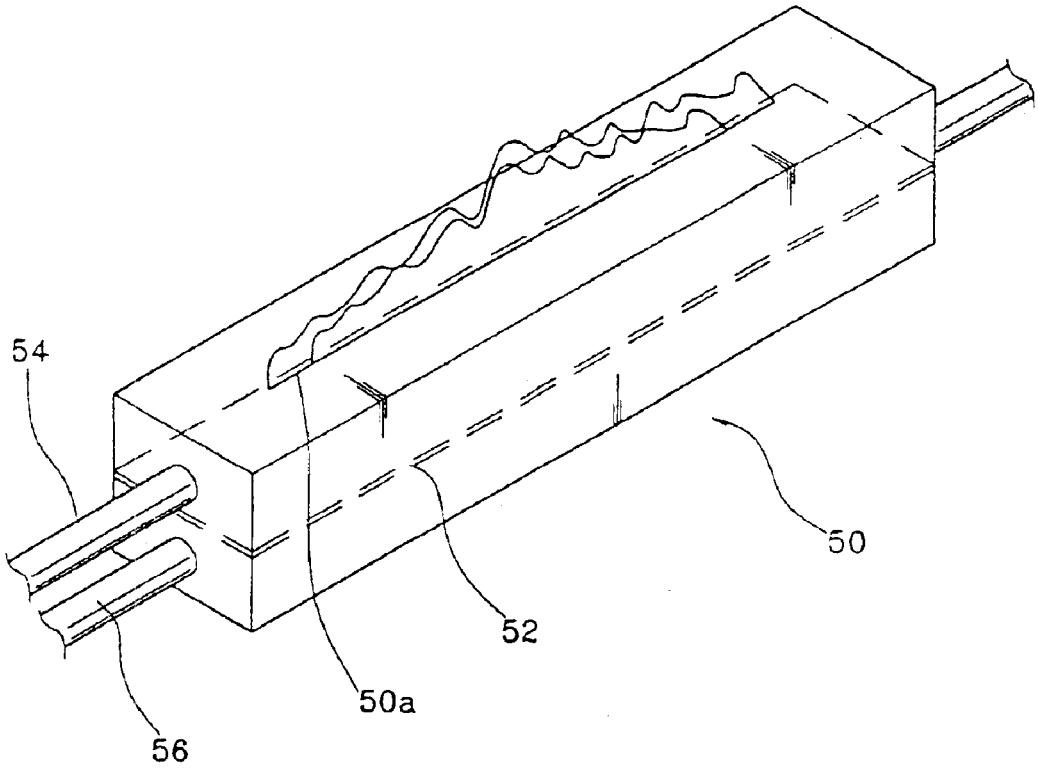
FIGS. 5 and 6 are perspective views of another burners in FIG. 3.

According to another embodiment of the burner, as shown in FIG. 5, a burner 50, which takes a generally square box shape, is provided with a flame hole 50*a* that is formed long along the length direction on the center of the upper surface and a partition 52 that is disposed on the center of the interior. Thus, heating gas is supplied through a gas inflow passage 54 to the upper portion of the partition 52 and cool water is supplied through a cool water inflow passage 56 to the lower portion of the partition 52, such that the temperature of the flame hole 50*a* can be low according to heat conductivity of the cool water while the flame is emitted through the flame hole 50*a*. Thereby, as the flame hole 50*a* is at a relatively low state, it has a strong resistance (i.e., melting and oxidization) to the flame. Therefore, the burner 50 can be made of a metal (e.g., aluminum) having a low melting point. With the metal at the low melting point, the flame hole 40*a* can be extremely small in size such that the length of the flame can be reduced. Thereby, the upper and lower widths of the combustion chamber can be reduced.

Figure 6:
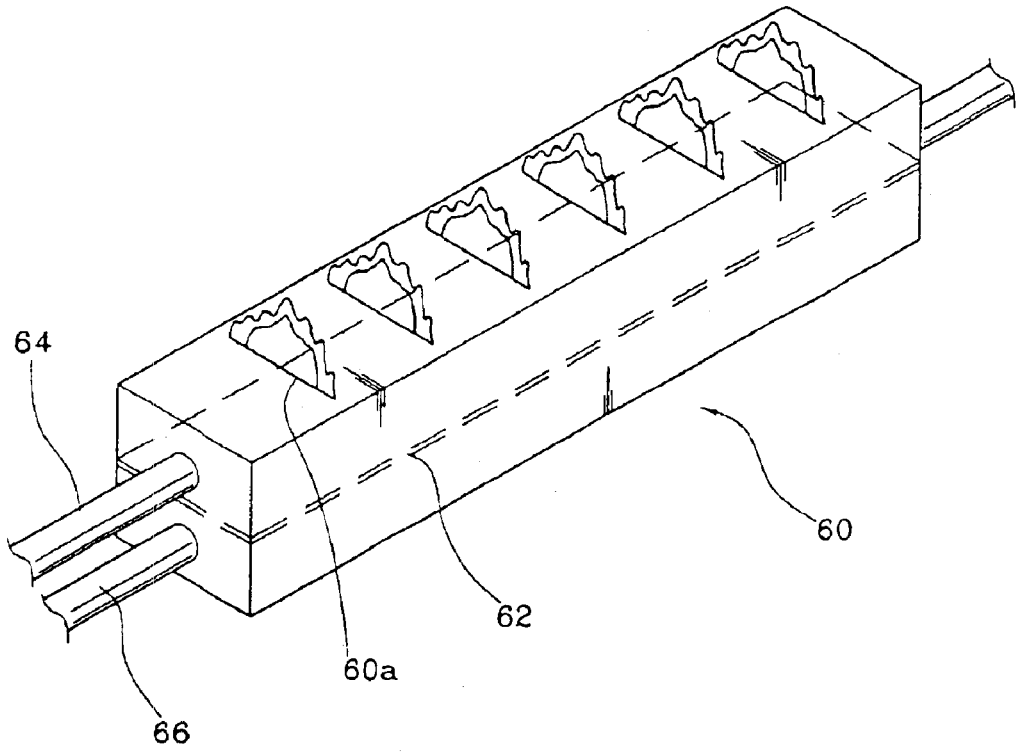

According to yet another embodiment of the burner, as shown in FIG. 6, a burner 60, which takes a generally square box shape, is provided with a plurality of flame holes 60*a* that are spaced away from each other and cut along the width direction on the center of the upper surface and a partition 62 that is disposed on the center of the interior. Thus, heating gas is supplied through a gas inflow passage 64 to the upper portion of the partition 62 and cool water is supplied through a cool water inflow passage 66 to the lower portion of the partition 62, such that the temperature of the flame holes 60*a* can be low according to heat conductivity of the cool water while the flames are emitted through the flame hole 60*a*. Thereby, as the flame holes 60*a* are at a relatively low state, they have a strong resistance (i.e., melting and oxidization) to the flames. Therefore, the burner 60 can be made of a metal (e.g., aluminum) having a low melting point. With the metal at the low melting point, the flame holes 60*a* can be extremely small in size such that the length of the flames can be reduced. Thereby, the upper and lower widths of the combustion chamber can be reduced.

Referring to FIG. 7, an explanation of the heat exchanging type boiler according to a fourth embodiment of the present invention will be described.

In this embodiment of the present invention, the bubble distributing plate 46 of the water retaining reservoir 10 is disposed in the center portion of the water retaining reservoir 10 and includes a predetermined amount of water and a space on the upper portion. And, the bubble distributing plate 46 is provided with a filter film 48 on the lower portion.

The filter film 48 has a predetermined amount of water and a space where the heating gas passing through the filter film 48 is refiltered and contains steam, on the upper portion.

The above construction is preferably embodied with such a water retaining reservoir that is capable of filtering fuel components that are not burnt yet, in the state where liquid fuel such as bunker C oil, heavy oil, and so on is not completely burnt up to 100% and produces the heating gas containing the fuel components.

In this case, preferably, the water retaining reservoir is provided with a water inlet hole (which is omitted) that is disposed on the corresponding side for supplying water to the upper portion of the filter film 48.

Instead of the bubble distributing plate 46 and the filter film 48 in the water retaining reservoir 10, a solid filter film such as a sponge having a relatively thick thickness can be disposed.

INDUSTRIAL APPLICABILITY

As set forth in the foregoing, a heat exchanging type boiler according to the present invention can transfer heat energy in heating gas to water, without passing through a heat transfer medium, distribute the bubbles of the heating gas to thereby enable heat transfer area to be maximized, and cause the even mixture of the water with a rising force produced while the bubbles of the heating gas rise in the water, whereby water heating speed can be considerably increased, heat efficiency of the boiler can be more improved, a volume of the boiler can be decreased, the life of the boiler can be semi-permanently extended since the water retaining reservoir is not directly heated, and the cleaning of the interior of the boiler can be carried out in an easy manner.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A heating boiler comprising a water reservoir for retaining water therein, a combustion chamber for emitting heated gases at a high temperature to the water in said water reservoir, and a bubble distributing plate disposed within the water reservoir and having a plurality of fine through holes such that the heated gases emitted to the water are distributed in substantially small bubble form, wherein a sprayer is disposed at an upper portion of said combustion chamber for spraying droplets of the water to the heated gases such that the heated gases produced from said combustion chamber are emitted to the water in said water reservoir, with steam of the water contained therein.

2. The boiler as defined in claim 1, wherein said combustion chamber is positioned lower than said water reservoir, and a heated gas supply conduit connects said combustion chamber and said water reservoir.

3. The boiler as defined in claim 3, wherein said heated gas supply conduit includes a valve for preventing the water from flowing from the water reservoir to the combustion chamber.

4. A heating boiler comprising a water reservoir for retaining water therein, a combustion chamber for emitting heated gases at a high temperature to the water in said water reservoir, a bubble distributing plate disposed within the water reservoir and having a plurality of fine through holes such that the heated gases emitted to the water are distributed in substantially small bubble form, and a burner disposed in said combustion chamber for producing the heated gases, said burner including a flame hole for a flame burning there-through and a water flow pipe disposed adjacent to said flame hole for preventing the melting and oxidization of said flame hole.

5. The boiler as defined in claim 4, wherein said flame hole is formed generally long in a length direction at the center of the top surface of the burner, and said water flow pipe is disposed on both sides of said flame hole.

6. The boiler as defined in claim 4, wherein said combustion chamber is positioned lower than said water reservoir, and a heated gas supply conduit connects said combustion chamber and said water reservoir.

7. The boiler as defined in claim 6, wherein said heated gas supply conduit includes a valve for preventing the water from flowing from the water reservoir to the combustion chamber.

8. A heating boiler comprising a water reservoir for retaining water therein, a combustion chamber for emitting heated gases at a high temperature to the water in said water reservoir, and a bubble distributing plate disposed within the water reservoir and having a plurality of fine through holes such that the heated gases emitted to the water are distributed in substantially small bubble form, wherein a filter is disposed at a lower portion separated by a predetermined distance from the bottom surface of said bubble distributing plate, for filtering impurities contained in the heated gases.

9. The boiler as defined in claim 8, wherein said filter contains a predetermined amount of water and is adapted to provide a space on the upper surface such that the heated gases passing through said filter contains steam of the water therein.

10. The boiler as defined in claim 8, wherein said combustion chamber is positioned lower than said water reservoir, and a heated gas supply conduit connects said combustion chamber and said water reservoir.

11. The boiler as defined in claim 10, wherein said heated gas supply conduit includes a valve for preventing the water from flowing from the water reservoir to the combustion chamber.

12. A heating boiler comprising a water reservoir for retaining water therein, a combustion chamber for emitting heated gases at a high temperature to the water in said water reservoir, a bubble distributing plate disposed within the water reservoir and having a plurality of fine through holes such that the heated gases emitted to the water are distributed in substantially small bubble form, and a burner disposed in said combustion chamber for producing the heated gases, said burner including a flame hole for a flame burning there-through and a partition disposed in an intermediate portion of the interior of said burner in such a manner that heating gases are supplied to the upper portion of said partition and cooling water is supplied to the lower portion thereof, such that the heat conductivity of the cooling water prevents the melting and oxidization of said flame hole.

* * * * *